US010370068B2

(12) United States Patent
Dieters

(10) Patent No.: US 10,370,068 B2
(45) Date of Patent: Aug. 6, 2019

(54) FLOATING DEBRIS REMOVAL WATERCRAFT AND METHOD

(71) Applicant: Eric Dieters, Solana Beach, CA (US)

(72) Inventor: Eric Dieters, Solana Beach, CA (US)

( * ) Notice: Subject to any disclaimer, the term of this patent is extended or adjusted under 35 U.S.C. 154(b) by 0 days.

(21) Appl. No.: 16/030,042

(22) Filed: Jul. 9, 2018

(65) Prior Publication Data

US 2019/0009867 A1 Jan. 10, 2019

Related U.S. Application Data

(60) Provisional application No. 62/529,835, filed on Jul. 7, 2017.

(51) Int. Cl.

| | |
|---|---|
| ***B63B 35/32*** | (2006.01) |
| ***B63B 25/00*** | (2006.01) |
| ***E02B 15/10*** | (2006.01) |
| ***B63B 25/28*** | (2006.01) |

(52) U.S. Cl.

CPC ..... *B63B 35/32* (2013.01); *B63B 25/004* (2013.01); *B63B 25/28* (2013.01); *E02B 15/10* (2013.01); *B63B 2714/02* (2013.01)

(58) Field of Classification Search

CPC ..... B63B 35/32; B63B 25/28; B63B 25/004
See application file for complete search history.

(56) References Cited

U.S. PATENT DOCUMENTS 3,268,081 A * 8/1966 Menkee ..... E02B 15/046 210/242.1
3,650,238 A * 3/1972 Stockdale ..... B63B 21/62 114/249
3,730,119 A * 5/1973 Budris ..... B63B 35/32 114/26
3,966,613 A * 6/1976 Kirk ..... B63B 35/32 210/242.3
3,974,923 A * 8/1976 Mark ..... B63B 27/143 43/8
4,458,621 A * 7/1984 De Clifford ..... B63B 35/00 114/255

(Continued)

OTHER PUBLICATIONS www.munsonboats.com (home page showing watercraft with front landing door). (Exhibit A).

(Continued)

*Primary Examiner* — S. Joseph Morano
*Assistant Examiner* — Jovon E Hayes
(74) *Attorney, Agent, or Firm* — Dean A. Craine, P.S.

(57) ABSTRACT

A floating debris pickup system that includes watercraft with a forward extending landing door located at the bow that can be selectively lowered or raised by the operator. Attached to the upper edge of the landing door is a rigid net frame. A net is attached to the net frame. During use, the landing door is partially lowered to position the net into the water. The watercraft then trolls to pick up floating debris in the net. The net frame includes at least two upper extending posts which are selectively engage to receivers attached to the landing door. The receivers and posts are oriented so that the net frame is aligned perpendicular to the landing door. The watercraft includes a davit system that allows the net fame to be attached and removed from the landing door and raises the net filled with debris over trash cans located in the hull.

13 Claims, 7 Drawing Sheets

(56) References Cited

U.S. PATENT DOCUMENTS

| | | | | |
|---|---|---|---|---|
| 5,839,216 | A * | 11/1998 | Baker | A01K 79/00 43/6.5 |
| 7,025,553 | B1 * | 4/2006 | Thomas | B63B 35/30 37/338 |
| 7,045,058 | B2 * | 5/2006 | Walczyk | B63B 35/32 210/170.05 |
| 7,341,012 | B2 * | 3/2008 | Loke | B63B 25/04 114/27 |
| 8,388,849 | B2 * | 3/2013 | Sherman | E02B 15/046 210/237 |
| 2005/0087119 | A1 * | 4/2005 | Pedersen | A01K 73/02 114/255 |
| 2019/0009867 | A1 * | 1/2019 | Dieters | B63B 35/32 |

OTHER PUBLICATIONS

Munson Boat Packman Landing Craft watercraft used with the invention (Exhibit B).

* cited by examiner

FLOATING DEBRIS REMOVAL WATERCRAFT AND METHOD

This U.S. non-provisional patent application is based upon and claims the filing date benefit of U.S. Provisional patent application (Application No. 62/529,835) filed on Jul. 7, 2017.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to floating debris removal systems used in large bodies of water. More particularly, the invention pertains to such systems that use a powered, maneuverable watercraft with a front net that can be selectively lowered into the water at different depths to capture floating debris and is then selectively raised out of the water and emptied into trash cans or a designated collection area on the watercraft.

Description of the Related Art

Municipalities along rivers, lakes and oceans, must deal with debris floating in the water. Not only is the floating debris unsightly, but also kills animals, causes disease and damages watercraft.

The nature and amount of floating debris in the body of water can vary depending on the activities in and around the water, the flow of the water, the nature of the shoreline, the size and shapes of docks and piers that extend into the water, and boat traffic. The debris can be scattered over large areas, confined to small areas, and in deep or shadow water. The debris may also be scattered in hard to reach areas, such as areas between docks and piers and between moored boats.

The nature, size and shape of the debris floating on the water can vary. Paper cups and bags are relatively small and float on the water and can be easily picked up with a small net pulled across the surface of the water. Larger objects, such as lifejackets, cushions, and coolers, usually float but are partially submerged making their removable more difficult using a small net. In order to remove these larger objects from the water, a larger net with a large opening must be used. Usually, the large opening must be partially submerged in the water adjacent to the object so that the entire object is captured by the net.

When the debris is scattered over a large area, the net may be left in the water while the watercraft is maneuvered back and forth over the area. Because waves and wind, and change of direction of the watercraft in the water can dislodge the debris collected by the net, it is important to lift the net from the water and periodically deposit the debris into a trash receptacle located on the watercraft.

Because the debris floating in the water may be widely scattered and may vary in size and shape, the cleanup activities by municipalities along rivers, lakes, and oceans is very time consuming and expensive.

What is needed is a relatively small maneuverable watercraft operated by one or two operators with a floating debris removal system can be selectively used in large and small bodies of water, in open bodies of water or in between docks, piers or adjacent to boats, and in both deep and shadow water. What is also needed is such a watercraft that can be adjusted to pickup both small or large pieces of floating debris regular or irregular in shape and may be partially submerged. What is also needed is such a watercraft that can be selectively adjusted 'on the fly' to pick up different sizes and shapes of debris.

SUMMARY OF THE INVENTION

The above stated problems confronted by municipalities to removed floating debris from a river, lake, to a large body of water are solved by the invention disclosed.

The invention is a floating debris removable watercraft system that includes a small maneuverable watercraft with a pivoting landing door on the front section of the bow that can be lowered or raised by the pilot or by a second operator on the watercraft. Watercrafts with landing doors are commonly used as rescue or equipment transport vessels when it is desirable to land the watercraft into a sandy beach and lower the landing door to allow individuals and equipment to depart from the watercraft. When the watercraft is moored next to a dock in calm or smooth seas, the landing door may be lowered to allow individuals and equipment to be easily loaded and unloaded from the bow.

The door on a landing watercraft is attached to hinges at a location on the bow above the water line. In calm or smooth waters (waves between 0 to 0.2 meters), the inventor has discovered that the landing watercraft may be partially lowered (the door's longitudinally axis is lowered up to approximately 30 degrees above the water line) if the watercraft is not moving forward in the water greater than 5 knots.

In the invention disclosed herein, a net assembly is attached to the landing door that extends perpendicularly and outward from outside surface of the landing door. The net assembly includes a rigid net frame that attaches to receivers attached to the landing door. The receivers are aligned on the landing door so that when the net frame is attached to the receivers, the net frame is aligned substantially perpendicular to the landing door's transverse axis. A net is attached to the net frame and oriented so that the top opening of the net is expanded and faces forward. The bottom end of the net is either permanently closed or selectively closed with a cinching strap.

During use, the landing door may be partially lowered up to a maximum angle of 30 degrees above the water line. When the landing door is closed, the top opening of the net is positioned out of the water. When fully lowered, approximately one half of the top opening of the net is placed in the body of water. By lowering the landing door different amounts, the pilot or operator can position the top opening at different depths into the water. For example, when trolling to pick up lightweight debris, such as paper, that floats on the top surface of the water, the landing door is lowered so only a portion of the top opening of the net is placed in the water. When trolling to pick up larger debris, such as pieces of wood, life vests, closed cell coolers, the landing door may be lowered further to position the top opening of the net is deeper in the water During use, the pilot or operator must constantly monitor the angle of the landing door, and the nature and size of the debris. The pilot or operator must also closely monitor the draft of the watercraft and the size of the waves to prevent flooding. In one embodiment, visual indicators are provided that inform the pilot or operator of the angle of the landing door relative to the hull.

When the landing door is closed, the net is diagonally aligned over the front surface of the bow and top opening of the net is pulled from the water. Because the bottom end of the net is closed, debris is retained inside the net. The invention also includes an optional davit system mounted on the watercraft. The davit system includes a lifting cable and straps that attaches to the net frame. During use, the lifting cable extends between the davit system and the straps. The davit system is then used to lift the lifting cable to reduce pressure exerted by the net frame on the receivers on the landing door so that pins that hold the posts inside the receives may be removed so that the net frame may be detached from the landing door. When the net frame is detached from the landing door, the davit system may be used to lift and reposition the net frame over a debris collection area on the watercraft. In one embodiment, a net includes a bottom end that is selectively closed by a cinching strap. When the net is positioned over the debris landing area, the cinching strap is released allowing the debris to fall from the net on to the debris collection area. Debris collection bins may be setup on the debris collection area so that the debris from the net may to directly deposited in the bins so that the collected debris may be easily unloaded from the watercraft.

DESCRIPTION OF THE PREFERRED EMBODIMENT(S)

Figure 3:
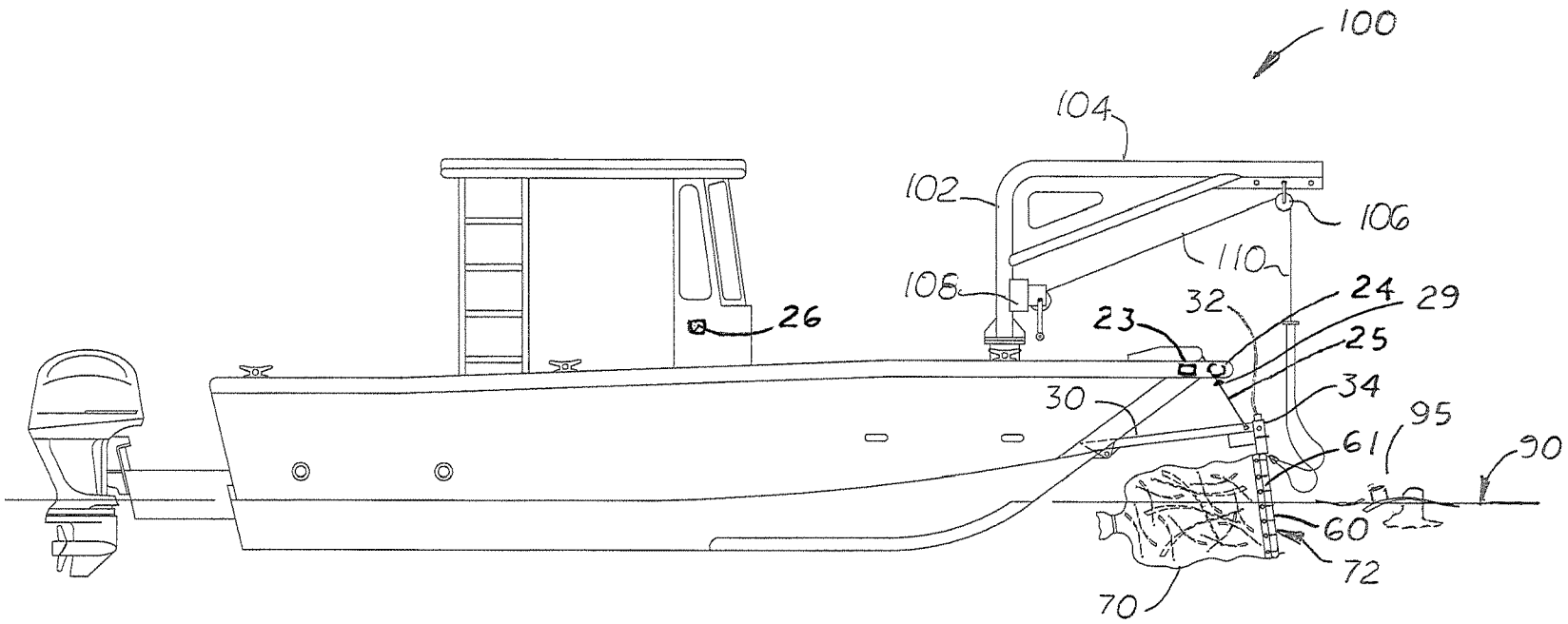
FIG. 3 is a watercraft showing the front landing door partially opened and sufficiently lowered so that the top opening on the net is positioned into the water and used to collecting floating debris.
Figure 4:
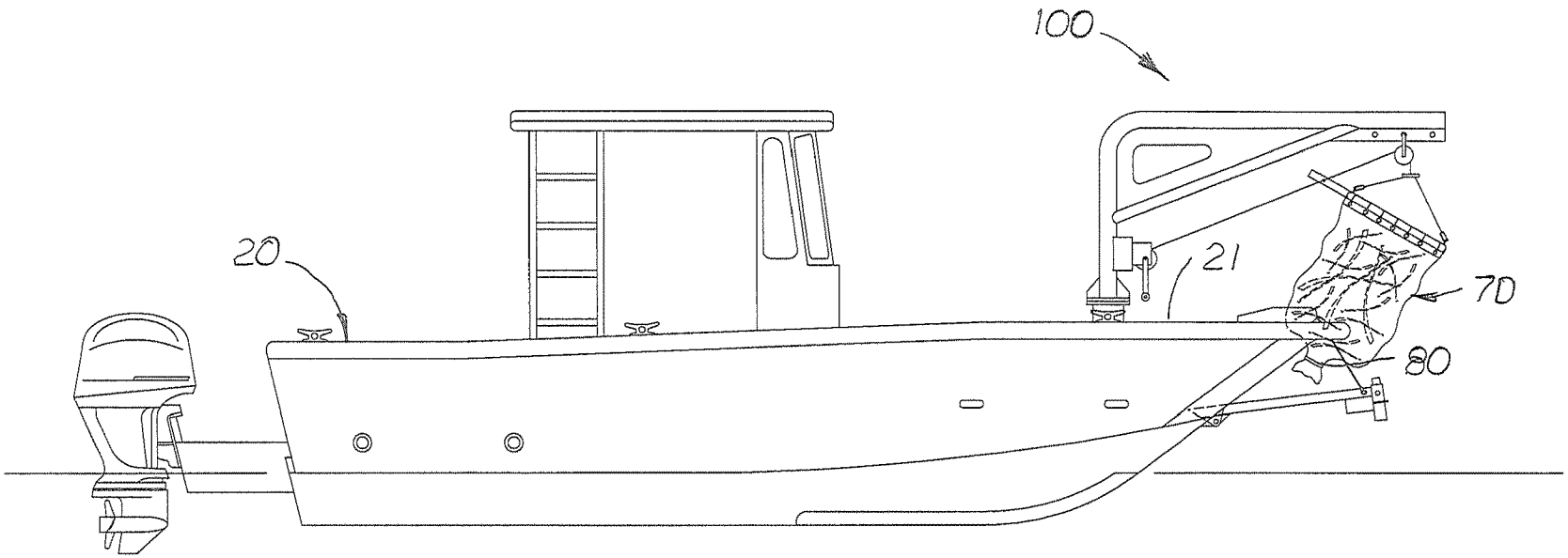
FIG. 4 is a watercraft showing the front landing door partially lowered and the net containing collected debris being lifted by the davit system.

Referring to the Figs., there is shown a floating debris pickup system 10 that includes a landing watercraft 20 with a forward extending landing door 30 located at the bow 21 that can be selectively lowered or raised by the pilot 8 or operator (not shown). In the embodiment shown herein, the landing door 30 pivotally attached at its lower edge to the bow 21. As shown in FIG. 3, one or more cables 25 wound onto one or more spools 24 located near the gunwale are attached at one end to the top edge or upper portion of the landing door 30. An electric motor 23 is coupled to the spools 24 which control the unwinding and rewinding of the cable 25 and the movement of the landing door 30. An optional control switch 26 coupled to the electric motor 23 is located near the pilot or operator.

Figure 6:
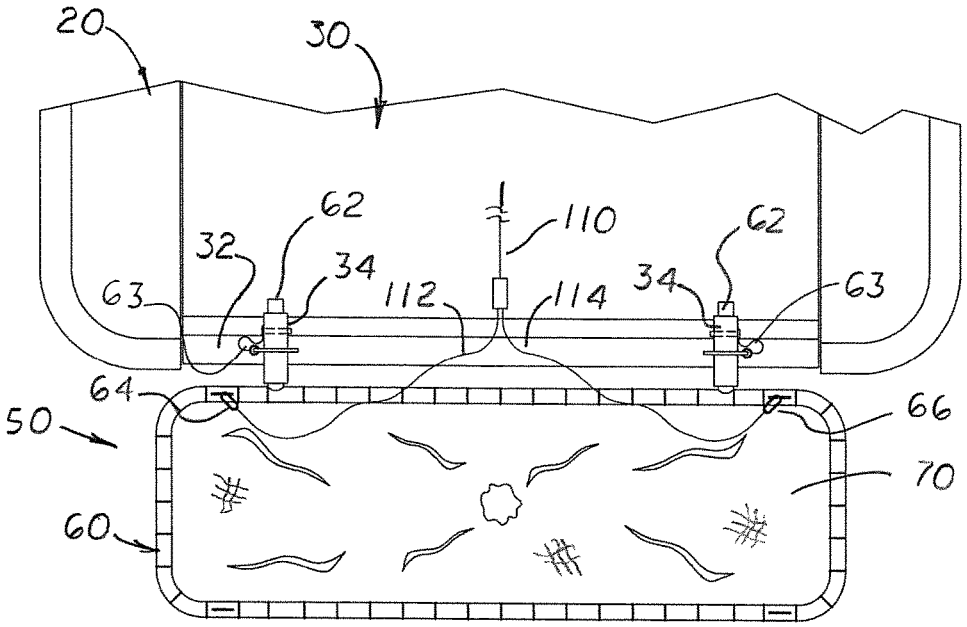
FIG. 6 is a top plan view of the net assembly attached to the landing door.
Figure 7:
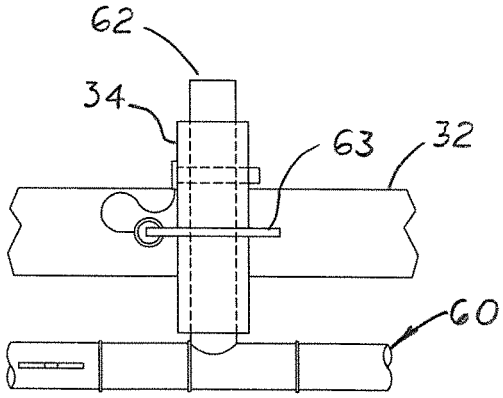
FIG. 7 is a partial top plan view showing the post attached to the net frame inserted into a receiver attached to the top edge of the landing door and a pin inserted into holes formed in the post and received to lock the post and receiver together.
Figure 8:
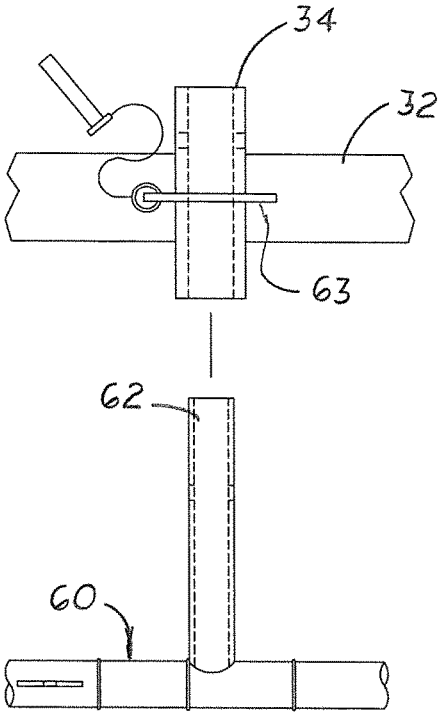
FIG. 8 is a partial top plan view showing the pin being removed allowing the post to be removed from the receiver enabling the net to detached from the landing door.

Attached to the upper edge 32 of the landing door 30 is a net assembly 50 that includes a rigid net frame 60 and a flexible net 70. The net assembly 50 selectively attaches to receivers 34 affixed to the landing door 30. The receivers 34 are aligned on the landing door 30 so that the net frame 60 when attached to the receivers 34 is substantially perpendicular to the landing door's transverse axis 31 (see FIG. 6). The net 70 is attached to the net frame 60 so that the top opening 72 of the net 70 is expanded and tilted upward and faces forward. The bottom end 74 of the net 70 is selectively closed so that debris 95 collected in the net 70 is retained.

Figure 1:
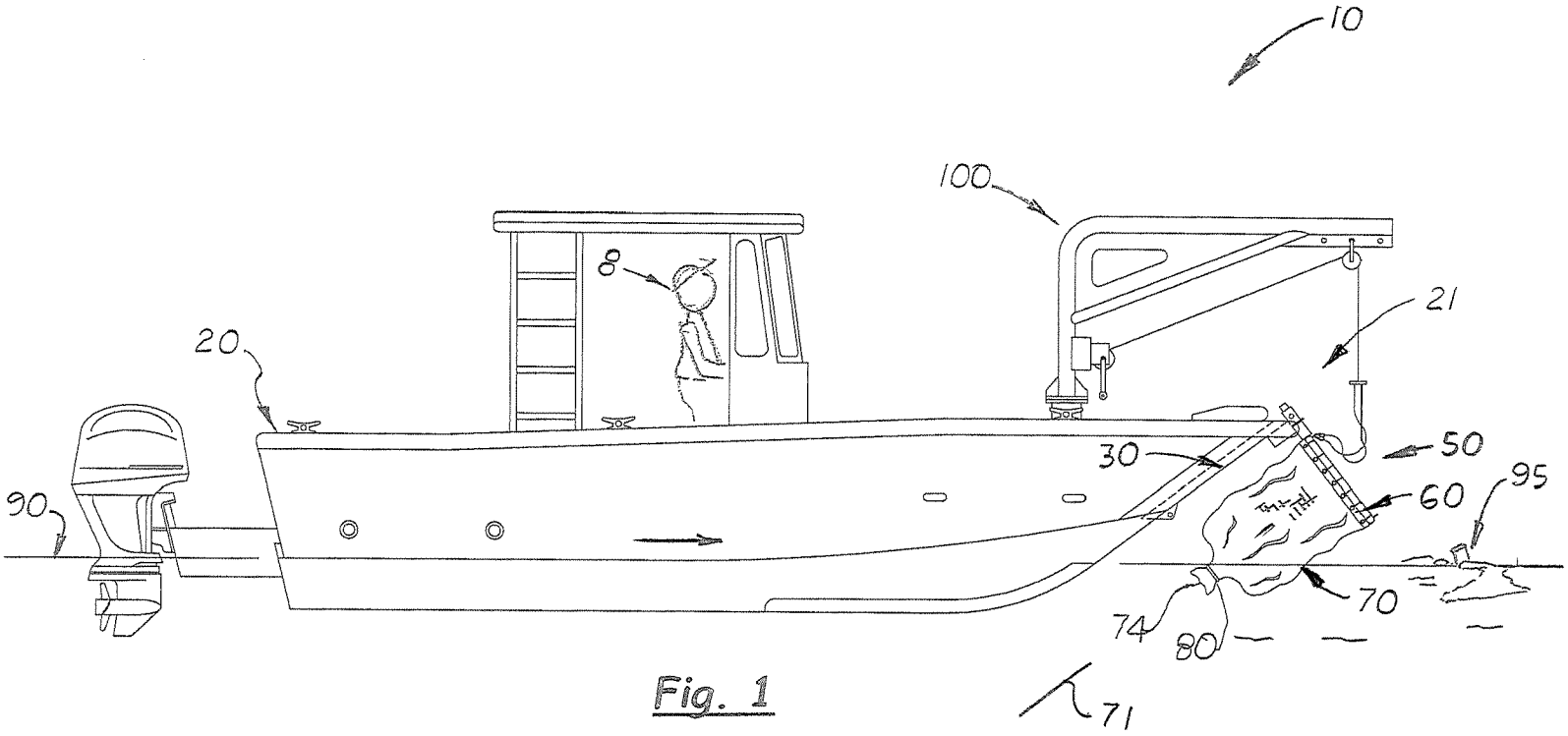
FIG. 1 is a side elevational view of a watercraft with a front landing door in a closed position, a rotating davit system in the bow of a watercraft of the hull, and a net assembly attached to the landing door shown partially lifted out of the water.
Figure 2:
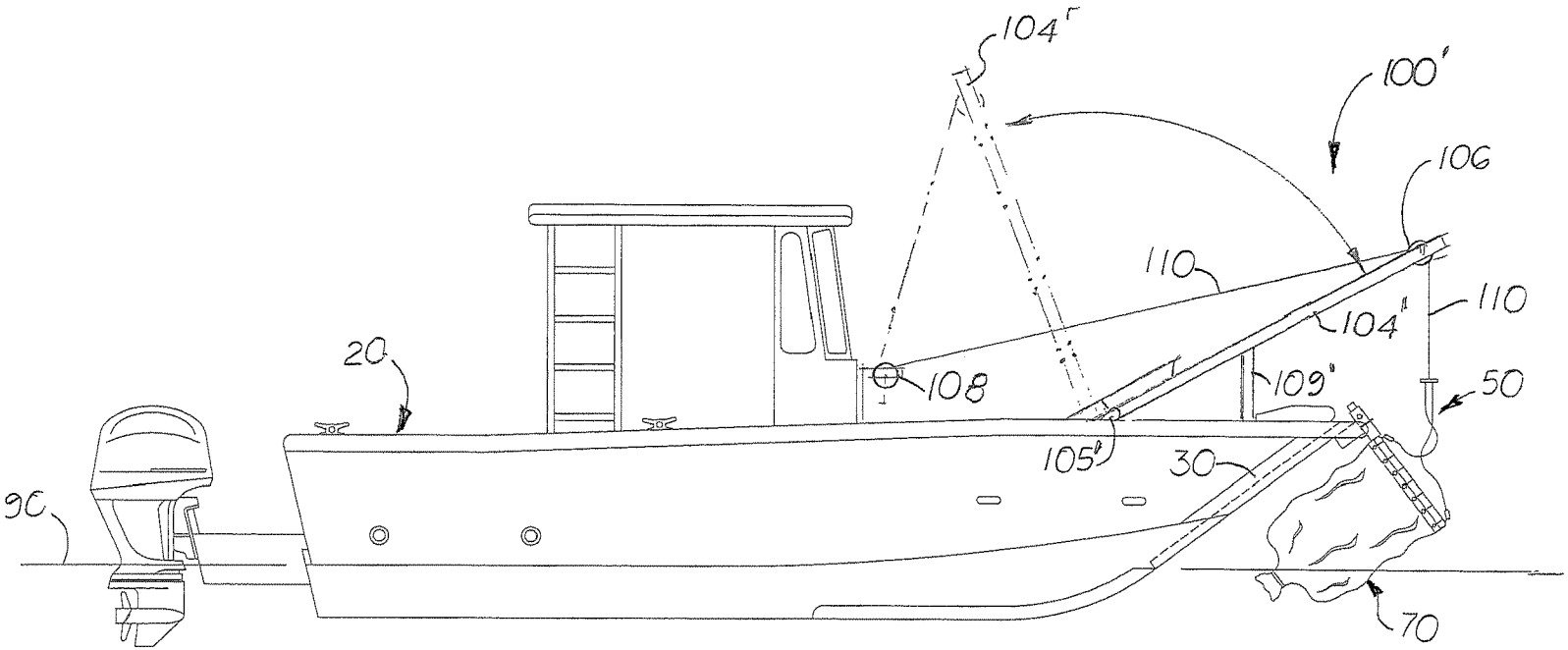
FIG. 2 is a side elevational view of a watercraft with a front landing door in a closed position, similar to FIG. 1 but with a pivoting davit system used in place of a rotating davit system.

As shown in FIGS. 1-3, during use, the upper edge 32 of the landing door 30 is partially lowered (up to approximately 30 degrees from the closed position) which places the lower edge of the net frame 60 and a portion of the top opening 72 of the net 70 into the body of water 90. When the watercraft 20 is trolling in a forward direction in the body of water 90, floating debris 95 travels into the top opening 72 and retained by the net 70. When all the floating debris 95 has been picked up, or if the net 70 is full of debris 95, the landing door 30 may be returned to the closed position. As the landing door 30 is closed, the longitudinal axis 71 of the net 70 is diagonally aligned and the top opening 72 of the net 70 is lifted out of the body or water 90 as shown in FIGS. 1 and 2.

A davit system 100 or 100' located on the watercraft 20 is then used to partially lift and support the net frame 60 and net 70 so the net frame 60 may be manually detached from the receivers 34 on the landing door 30. After detaching the net frame 60 from the landing door 30, the davit system 100 or 100' is then used to re-position net frame 60 and net 70 over a debris collection area on the watercraft 20. In the embodiment shown, the end of the bottom end 74 of net 70 is opened and selectively closed by a cinching strap 80. When emptying the net 70, the cinching strap 80 is relaxed so that debris 95 may fall from the net 70 onto the debris collection area or into a debris collecting bin 120.

Figure 5:
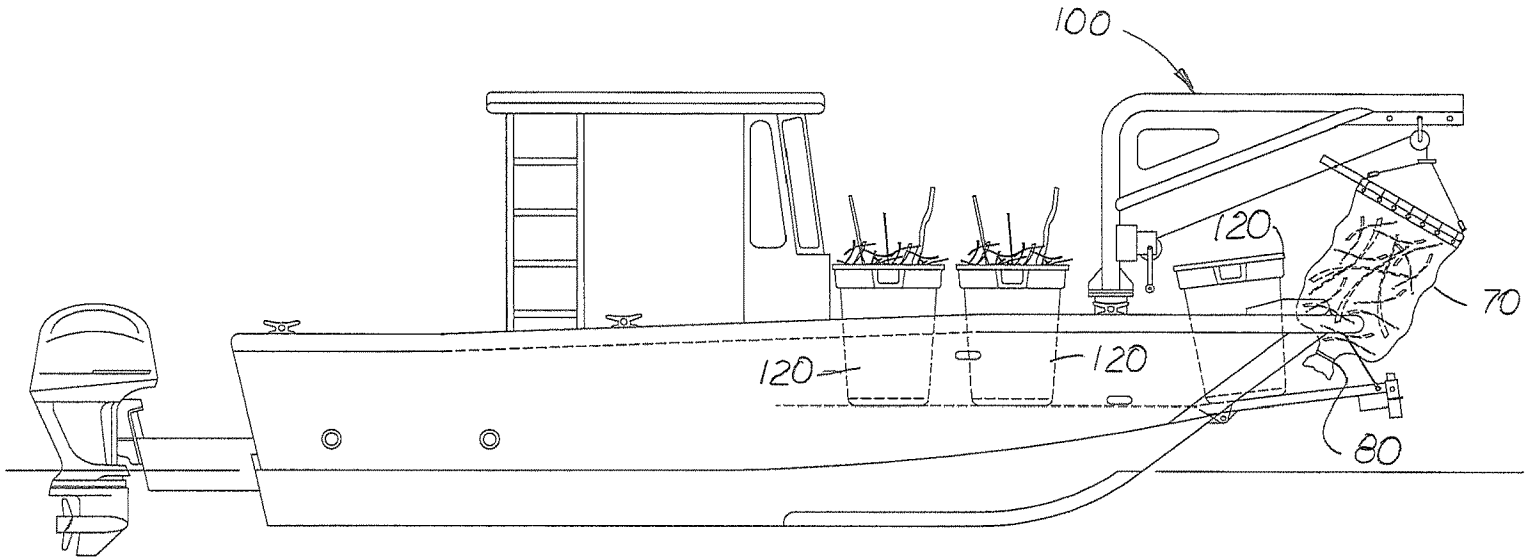
FIG. 5 is a watercraft with debris collection bins in the storage area in the hull filled with collected debris.

As shown more clearly in FIG. 5, the net frame 60 is a rectangular structure approximately the same length as the landing door 30. The net frame 60 includes a surrounding frame member 61 with at least two upper extending posts 62 configured to selectively engage receivers 34 attached or formed on the upper edge 32 of the landing door 30. The two posts 62 are axial aligned with the plane of the net frame 62. Also, the receivers 34 and posts 62 are oriented so that when the posts 62 are inserted into the receivers 34, the net frame 60 is located over the front surface of the landing door 30 and aligned perpendicular to the door's upper edge 32. Pins 63 extend transversely through the receivers 34 and posts 62 to securely attach the posts 62 to the receivers 34.

FIGS. 1 and 3-5 show a first davit system 100 that includes a rotating center post 102 attached to the hull, a horizontal arm 104, an outer pulley 106, a retracting cinch 108, and a lift cable 110. One end of the lift cable 110 is attached to the cinch 108. The opposite end of the lift cable 110 is attached to two branch cables 112, 114. During assembly, the distal ends of the branch cables 112, 114, are attached to two eyelets 64, 66, respectively, formed or attached to the surrounding frame member 61, (see FIG. 6).

FIG. 2 shows a second davit system 100' that includes a least one pivoting mast 104' that swings rearward and forward over the pivot joint 105'. The mast 104' includes at least one support brace 109' used to hold the mast 104' over the landing door 30. Mounted on the distal end of the mast 104' is a pulley 106. Mounted on the watercraft 20 is a cinch 108 on which a lift cable 110' is wound. During use, the lift cable 110' is shortened to lift the net assembly 50. After the net assembly 50 has been detached from the landing door 30, the lift cable 110' is then further shortened causing the mast 104' to pivot upward and reposition the net assembly 50 over the watercraft 20.

During use, the landing door 30 is partially lowered to position the net frame 60 and the net 70 into the water 90. The cables 25 used to lower and raise the landing door 30 may include visual markers 29 that inform the pilot how far the landing door 30 is extend forward. The final position of the landing door 30 may be adjusted so that the top opening 72 of the net 70 faces forward and positioned at a desired depth or orientation relative to the top surface of the water 90.

Figure 9:
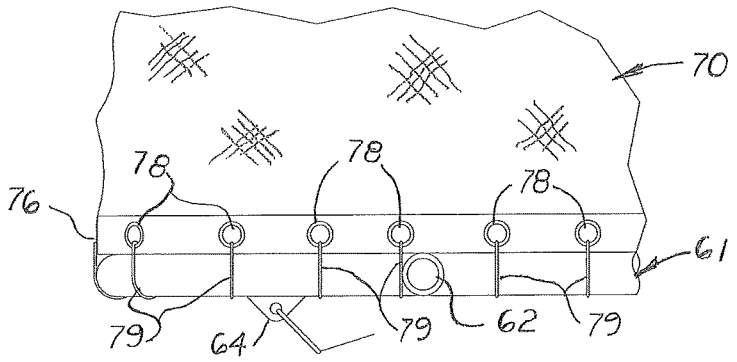
FIG. 9 is a partial top plan view of the net frame and the top edge of the net showing how the net is attached to the net frame.
Figure 10:
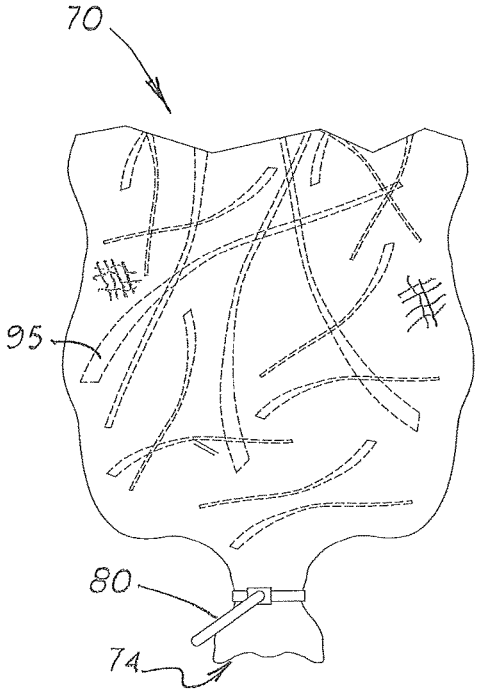
FIG. 10 is a side elevational view showing the lower end a net filled with debris with a cinching strap tightened to close the bottom end of the net.
Figure 11:
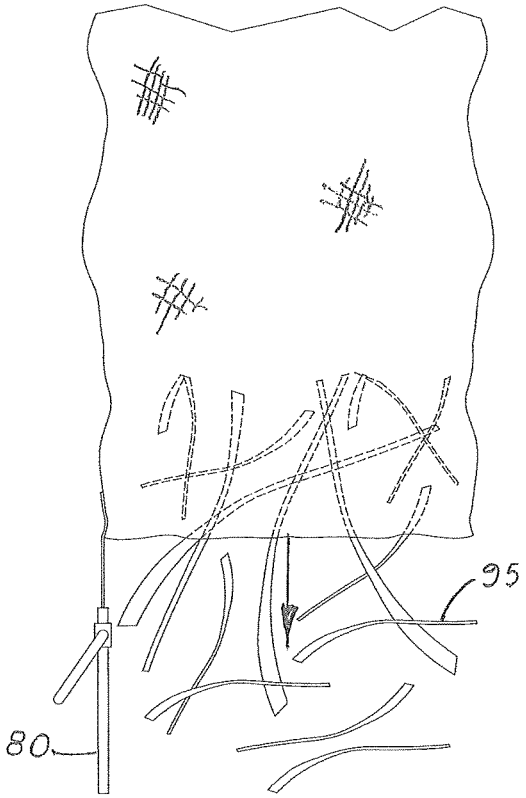
FIG. 11 is a side elevational view showing the bottom end a net filled with debris with the cinching strap loosened allowing debris to fall through the bottom end of the net.

As shown in FIG. 9, the top edge 76 of the net 70 includes a plurality of eyelets 78. During assembly, straps 79 are extended around the surrounding frame member 61 and through the eyelets 78 formed on the net 70 to attach the net 70 to the surrounding frame member 61.

When the net 70 is filled with debris, the net frame 60 needs to be detached from the landing door 30. To detach the net frame 60 from the landing door 30, the net frame 60 is lifted by the davit system 100 to relieve pressure and reduce friction on the pins 80 so they may be removed from the holes in the receivers 34 and posts 62. When the pins 80 are removed, the posts 62 can slide outward and removed from the receivers 34. The lifting cable 110 is then shortened to lift the net frame 60 away from the landing door 30. The center post 102 on the davit system 100 is then rotated to reposition the bottom end 74 of the net 70 over the collection bin 120 or over a debris deposit area on the watercraft 20. If the net 70 has a bottom end 74 closed by a cinching strap 80, the cinching strap 80 is loosened to allow the debris to fall from the bottom end 74 on the net 70. If the bottom end 74 of the net 70 is closed end, the net 70 must be held up-side-down over the bin 120 or debris collection area to empty the net 70. When all of the debris 95 has been removed from the net 70, the cinching strap 80 is then tightened to close the bottom end 74. The davit system 100 is then used to reposition the net frame 60 over the landing door 30 and reconnect the receivers 34 and posts 62.

The method of removing debris from a body of water 90 is disclosed comprising the following steps:

a. selecting a watercraft 20 with a forward pivoting landing door 30 located at the bow 21 and a davit system 100 configured to lift a net 70 filled with debris 95 attached to the landing door 30, said landing door 30 configured to be lower or raised;

b. selecting a net assembly 50 that includes a net 70 with top opening 72 and a closed bottom end 74, said net 70 being attached to a rigid net frame 60 configured to hold said top opening 72 in an expanded configuration when said net frame 60 is positioned in the body of water 90;

c. attaching said net frame 60 to said landing door 30 so that said net frame extends downward from said landing door 30 and said opening 72 of said net 70 faces forward and is positioned above said body of water 90 when the landing door 30 is closed and partially extends into said body of water 90 when the landing door 30 is partially opened, said net 70 configured so that said closed end 74 faces rearward to collect said debris 95;

d. trolling said watercraft 20 in a forward direction through said body of water 90;

e. lowering said landing door 30 so that said top opening 72 of said net 70 is at least partially submerged in said body of water 90 and faces in a forward direction so that said debris 95 floating on said body of water 90 travels through said top opening 72 and collected in said net 70;

f. raising said landing door 30 so that said top opening 72 of said net 70 is removed from said body of water 90;

g. attaching said davit system 100 to said net frame 60, and applying a lifting force to said net frame 60 so that said net frame 60 may be detached from said landing door 30;

h. detaching the net frame 60 from the landing door 30; and i. lifting the net 70 onto the watercraft 20 and emptying the debris 95 from said net 70.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A floating debris pickup system comprising:

a. a watercraft with a bow and a transversely aligned, forward extending, a pivoting landing door located at said bow configured to be opened at different angles relative to a body of water in which said watercraft is placed, said landing door includes an outside surface, a longitudinal axis, a transverse axis, and an upper surface;

b. a rigid net frame selectively attached to said landing door and configured so that when said landing door is closed on said watercraft, the net frame is positioned out of a body of water and partially submerged in said body of water when said landing door is opened at different angles;

c. a net attached to said net frame, said net includes an opened end and a closed end, and d. a davit system configured to selectively attach to said net frame to move said net frame and said net to a debris collection area on said watercraft.

2. The floating debris pickup system, as recited in claim 1, wherein said davit system is located on said watercraft.

3. The floating debris pickup system, as recited in claim 1, further including at least two receivers attached or formed on said landing door configured to attach to said net frame.

4. The floating debris pickup system, as recited in claim 3, further including at least two posts attached to said net frame configured to be inserted into said receivers to hold said net frame on said landing door.

5. The floating debris pickup system, as recited in claim 3, wherein each said receiver includes a longitudinal axis and is attached to said upper surface of said landing door so that its said longitudinal axis is perpendicular to said landing door's transverse axis.

6. The floating debris pickup system, as recited in claim 2, wherein said davit system includes a vertically aligned center post mounted on said watercraft, a horizontal arm attached at one end to said center post, at least one outer pulley, and a lift cable traveling over said outer pulley and configured to selectively attach to said net frame.

7. The floating debris pickup system, as recited in claim 2, wherein said davit system includes at least one pivoting mast with an outer pulley, and a lift cable traveling over said outer pulley and configured to selectively attach to said net frame.

8. The floating debris pickup system, as recited in claim 1, wherein said net frame is rectangular with a center opening.

9. The floating debris pickup system, as recited in claim 8, wherein said net includes an upper edge that is attached to said net frame.

10. The floating debris pickup system, as recited in claim 3, wherein said net frame includes a surrounding frame member and at least two perpendicularly aligned posts configured to engage said receivers on said landing door.

11. The floating debris pickup system, as recited in claim 10, further including pins configures to extend through said posts and said receivers when connected and lock said posts and said receivers together.

12. The floating debris pickup system, as recited in claim 1, wherein said net has a bottom end configured to be selectively closed to collect debris and selectively opened to empty said net.

13. The method of removing debris from a body of water, comprising the following steps:

a. selecting a watercraft with a landing door located at the bow of the hull and a davit system configured to lift a net filled with debris attached to the landing door, said landing door configured to be lower or raised;

b. attaching said net with an open end and a close end, said net attached to said landing door so that said open end may be lowered into said body of water so that at least part of the open end is submerged in said body of water;

c. trolling said watercraft through said body of water with floating debris;

c. lowering said landing door so said open end of said net is at least partially submerged and faces in a forward direction;

d. raising the landing door so that said open end of said net is removed from said body of water; and e. attaching the davit system to said net and lifting said net onto said watercraft and emptying said debris from said net.

* * * * *